US007909439B2

(12) United States Patent
Hirano et al.

(10) Patent No.: US 7,909,439 B2
(45) Date of Patent: Mar. 22, 2011

(54) LIQUID EJECTING HEAD AND LIQUID EJECTING APPARATUS

(75) Inventors: Akemi Hirano, Shiojiri (JP); Akira Matsuzawa, Shiojiri (JP)

(73) Assignee: Seiko Epson Corporation, Shinjuku-ku, Tokyo (JP)

( * ) Notice: Subject to any disclaimer, the term of this patent is extended or adjusted under 35 U.S.C. 154(b) by 173 days.

(21) Appl. No.: 12/409,426

(22) Filed: Mar. 23, 2009

(65) Prior Publication Data

US 2009/0273653 A1 Nov. 5, 2009

(30) Foreign Application Priority Data

Mar. 24, 2008 (JP) ..... 2008-075312

(51) Int. Cl.
*B41J 2/045* (2006.01)

(52) U.S. Cl. ..... 347/71

(58) Field of Classification Search ..... 347/71, 347/68–69, 70, 72; 400/124.14, 124.16; 310/311, 324, 327, 358, 365
See application file for complete search history.

(56) References Cited

U.S. PATENT DOCUMENTS

| | | | | |
|---|---|---|---|---|
| 6,869,170 | B2 * | 3/2005 | Shimada et al. | 347/68 |
| 7,364,273 | B2 * | 4/2008 | Takahashi | 347/68 |
| 2008/0252697 | A1 * | 10/2008 | Kamei | 347/71 |

FOREIGN PATENT DOCUMENTS

JP 2006-082529 A 3/2006

* cited by examiner

*Primary Examiner* — K. Feggins
(74) *Attorney, Agent, or Firm* — Kilpatrick Townsend & Stockton LLP

(57) ABSTRACT

A liquid ejecting head includes: a flow passage forming substrate which is provided with a plurality of liquid passages each having a pressure generating chamber communicating with a nozzle opening for ejecting a liquid and a communication section communicating with the plurality of liquid passages; an elastic film which is formed on one surface of the flow passage forming substrate and has an opening in an area opposed to the communication section; a pressure generating unit which applies pressure to the inside of the pressure generating chambers; and a reservoir forming substrate which is adhered onto the surface of the flow passage forming substrate on a side of the pressure generating unit and is provided with a reservoir section communicating with the communication section to form a part of a reservoir. An intermediate layer patterned inward from the opening of the elastic film is formed in an area which is a periphery of the communication section on the elastic film and corresponds to the liquid passages, and the flow passage forming substrate and the reservoir forming substrate are adhered to each other through the intermediate layer. An end portion of the intermediate layer on a side of the opening of the elastic film is formed as a tapered portion of which a thickness is gradually smaller, and a cross-section shape in a direction which the thickness of the tapered portion is gradually smaller is a concavely curved plane.

4 Claims, 8 Drawing Sheets

LIQUID EJECTING HEAD AND LIQUID EJECTING APPARATUS

This application claims priority to Japanese Patent Application No. 2008-075312, filed Mar. 24, 2008, the entire disclosure of which is expressly incorporated by reference herein.

BACKGROUND

1. Technical Field

The present invention relates to a liquid ejecting head and a liquid ejecting apparatus capable of ejecting a liquid, and particularly to an ink jet printing head and an ink jet printing apparatus capable of ejecting ink as the liquid.

2. Related Art

As an ink jet printing head which is a liquid ejecting head, there is known an ink jet printing head which includes a flow passage forming substrate provided with pressure generating chambers individually communicating with nozzle openings and a communication section communicating with the pressure generating chambers, piezoelectric elements formed on one surface of the flow passage forming substrate, and a reservoir forming substrate provided with a reservoir section joined with the surface of the flow passage forming substrate on which the piezoelectric elements are formed and forming a part of a reservoir together with the communication section. In the ink jet printing head, the flow passage forming substrate and the reservoir forming substrate are adhered to each other through an adhesive layer (for example, see JP-A-2006-082529).

However, the ink jet printing head having the above-described configuration has a problem in that crack may occur in an area corresponding to liquid passages of an elastic film formed on the flow passage forming substrate.

This problem occurs not only in the ink jet printing head ejecting ink but also in the other liquid ejecting heads ejecting a liquid other than ink.

SUMMARY

An advantage of some aspects of the invention is that it provides a liquid ejecting head and a liquid ejecting apparatus improving reliability by preventing crack from occurring in an area corresponding to liquid passages of an elastic film.

According to an aspect of the invention, there is provided a liquid ejecting head including: a flow passage forming substrate which is provided with a liquid passage having a pressure generating chamber communicating with a nozzle opening for ejecting a liquid and a communication section communicating with the liquid passage; an elastic film which is formed above one surface of the flow passage forming substrate and has an opening in an area opposed to the communication section; a pressure generating unit which applies pressure to the inside of the pressure generating chamber; and a reservoir forming substrate which is adhered onto the flow passage forming substrate above a side of the pressure generating unit and is provided with a reservoir section communicating with the communication section to form a part of a reservoir. An intermediate layer patterned inward from the opening of the elastic film is formed in an area which is the periphery of the communication section on the elastic film and corresponds to the liquid passage, and the flow passage forming substrate and the reservoir forming substrate are adhered to each other through at least the intermediate layer. In addition, an end portion of the intermediate layer on a side of the opening of the elastic film is formed as a tapered portion of which a thickness is gradually smaller, and a cross-section shape in a direction in which the thickness of the tapered portion is gradually smaller is a concavely curved plane.

According to the liquid ejecting head, the end portion of the intermediate layer above the side of the opening of the elastic film is formed as the tapered portion of which the thickness is gradually smaller and the cross-section shape in the direction the thickness of the tapered portion is gradually smaller is the concavely curved plane. Therefore, even when the adhesive layer is thermally expanded and stress thus occurs due to occurrence of bubbles in the adhesive layer or mixing of a foreign substance, the stress is not focused on the end portion of the intermediate layer above a side of the elastic film. Accordingly, it is possible to prevent crack from occurring in an area corresponding to the liquid passages of the elastic film. Moreover, it is possible to improve reliability.

The liquid ejecting head according to this aspect of the invention may further include a metal layer which is provided to cover at least a part of an upper surface of the intermediate layer and the end portion of the intermediate layer on the side of the opening of the elastic film. A surface of the metal layer in an area corresponding to the tapered portion of the intermediate layer is shaped in a concavely curved plane. With such a configuration, the stress is not focused on the end portion of the intermediate layer on the side of the opening of the elastic film. Accordingly, it is possible to prevent crack from occurring in the area corresponding to the liquid passages of the elastic film. Moreover, it is possible to improve reliability.

In the liquid ejecting head according to this aspect of the invention, the pressure generating unit may be a piezoelectric element including a lower electrode, a piezoelectric layer, and an upper electrode, the intermediate layer may be formed of an insulating film, and the metal layer may be a discontinuous metal layer which is formed of the same material as that of a lead electrode drawn from the piezoelectric element and is discontinuous from the lead electrode. With such a configuration, it is possible to prevent crack from occurring in the area corresponding to the liquid passages of the elastic film.

According to another aspect of the invention, there is provided a liquid ejecting apparatus including the liquid ejecting head. With such a configuration, by preventing crack from occurring in the area corresponding to the liquid passages of the elastic film, it is possible to provide the liquid ejecting apparatus improved in reliability.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described in detail.

Figure 1:
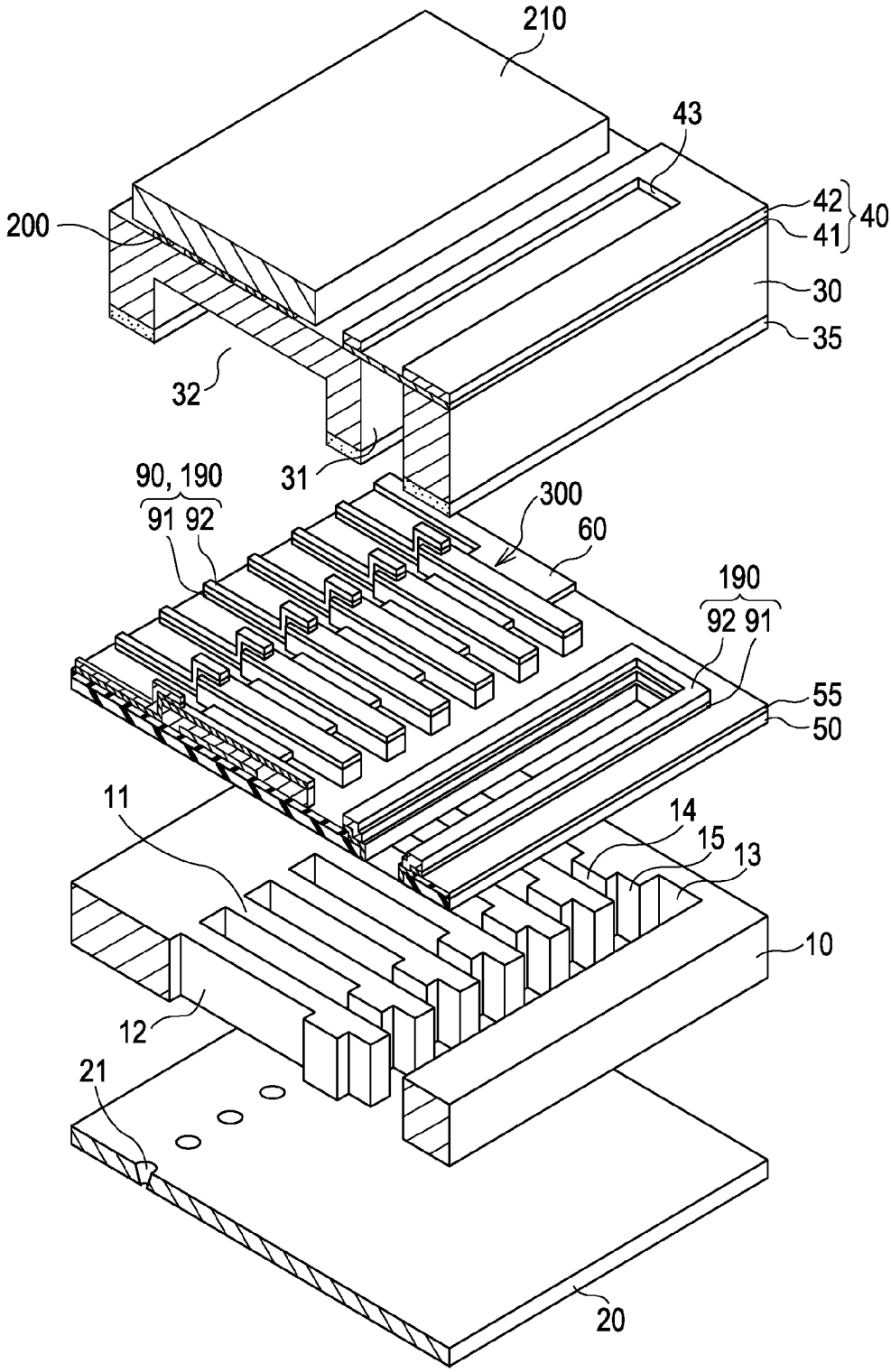
FIG. 1 is an exploded perspective view illustrating the overall configuration of a printing head according to a first embodiment.
Figure 2A:
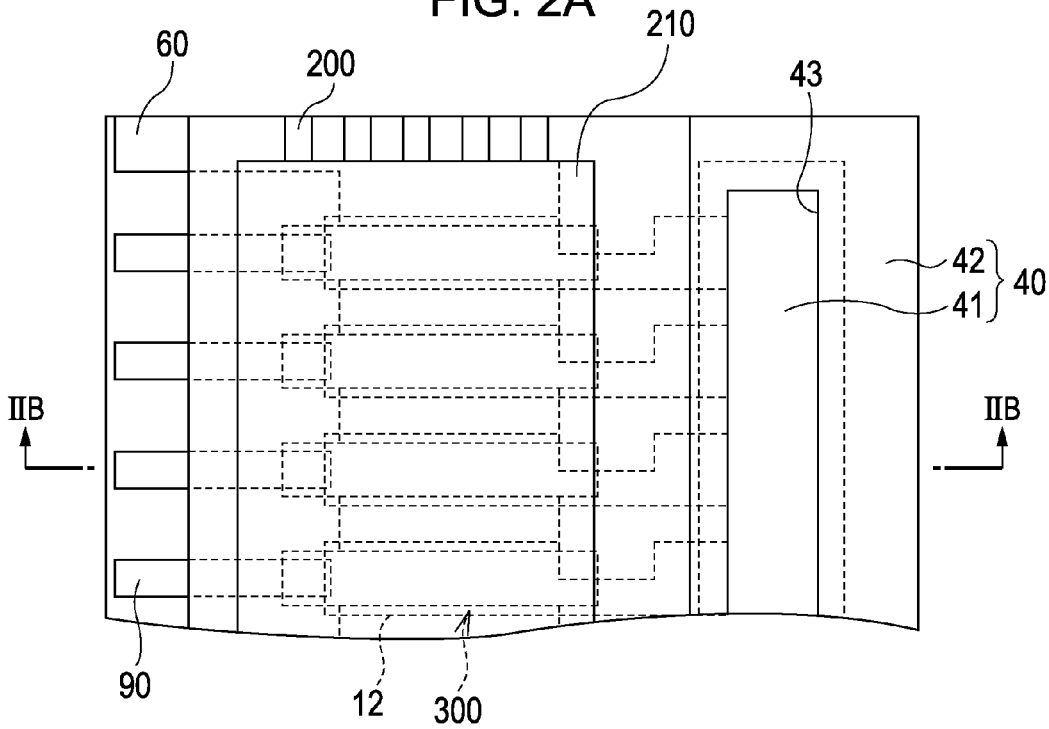
FIGS. 2A and 2B are a top view and a sectional view illustrating the printing head according to the first embodiment, respectively.
Figure 2B:
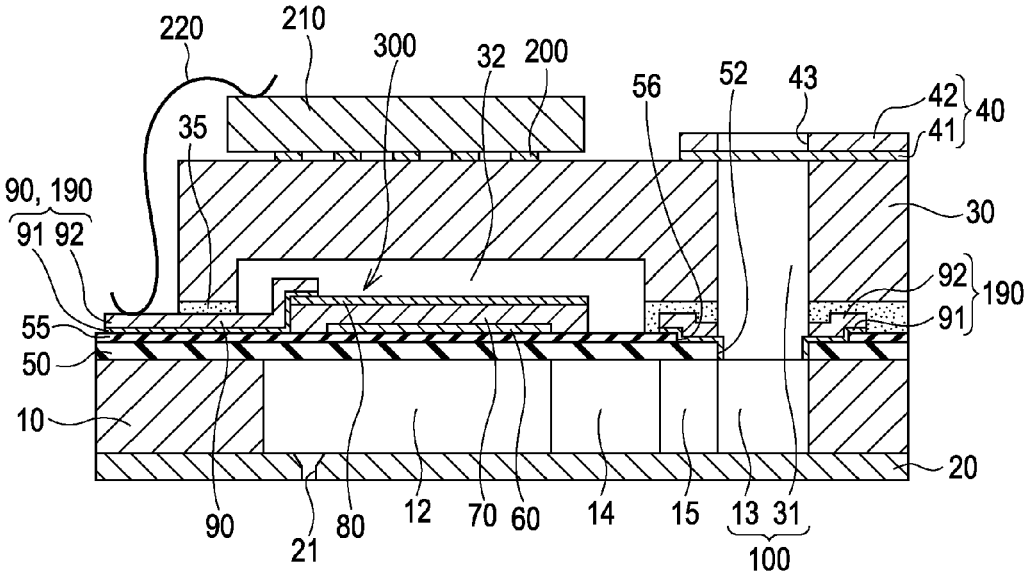
Figure 3:
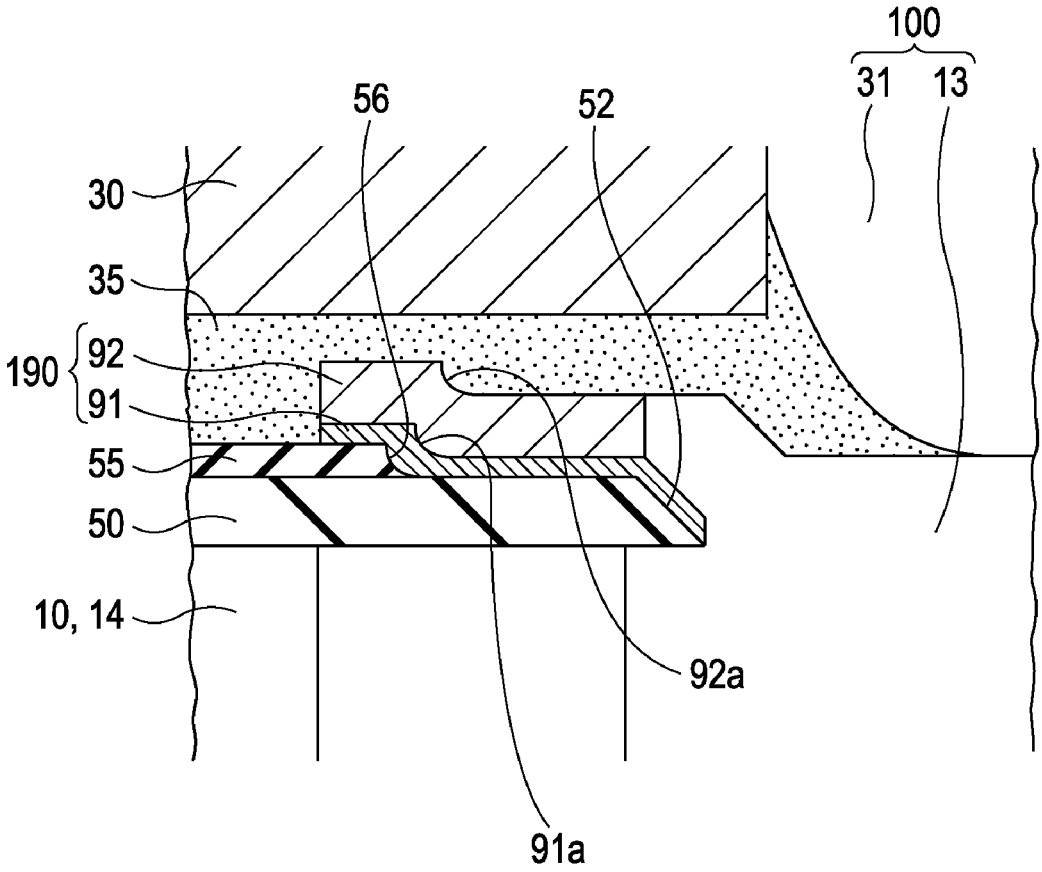
FIG. 3 is an expanded sectional view illustrating the vicinity of a reservoir of the printing head according to the first embodiment.

FIG. 1 is an exploded perspective view illustrating the overall configuration of an ink jet printing head as an example of a liquid ejecting head according to the embodiment. FIGS. 2A and 2B are a top view of FIG. 1 and a sectional view taken along the line IIB-IIB of FIG. 2A, respectively. FIG. 3 is an expanded sectional view illustrating the vicinity of a reservoir.

As illustrated in the drawings, in this embodiment, a flow passage forming substrate 10 is formed of a silicon single crystal substrate. In addition, an elastic film 50 formed of silicon dioxide is formed in advance on one surface of the flow passage forming substrate 10. Pressure generating chambers 12 partitioned by a plurality of partition walls 11 are arranged in parallel in the flow passage forming substrate 10 in the width direction (transverse direction). Ink supply passages 14 and communication passages 15 are partitioned by the partition walls 11 in one ends in a longitudinal direction of the pressure generating chambers 12 of the passage forming substrate 10. A communication section 13 communicating with the communication passages 15 is formed outside the communication passages 15. As described in detail, the reservoir forming substrate 30 is joined onto the surface of the flow passage forming substrate 10 on the side of the elastic film 50. In addition, the communication section 13 communicates with a reservoir section 31 provided in the reservoir forming substrate 30 to form a part of a reservoir 100 which is a common ink chamber of the pressure generating chambers 12. That is, in this embodiment, the pressure generating chambers 12, the ink supply passages 14, the communication passages 15 are provided as liquid passages formed in the flow passage forming substrate 10. The liquid passages communicate with the communication section 13.

A nozzle plate 20 through which nozzle openings 21 individually communicating with the pressure generating chambers 12 are punched is fixed and adhered to an opening surface of the flow passage forming substrate 10 by an adhesive or a heat welding film. The nozzle plate 20 is formed of glass ceramics, a silicon single crystal substrate, stainless steel, or the like, for example.

On the other hand, the elastic film 50 is formed opposite the opening surface of the passage forming substrate 10, as described above, and an insulating film 55 as an intermediate layer is formed on the elastic film 50.

Piezoelectric elements 300 each including a lower electrode film 60, a piezoelectric layer 70, and an upper electrode film 80 are formed on the insulating film 55. In this embodiment, the lower electrode film 60 serves as a common electrode of the piezoelectric elements 300 and the upper electrode film 80 serves as an individual electrode of each of the piezoelectric elements 300. However, the reverse configuration is also possible depending on the restriction on a driving circuit or wirings.

A lead electrode 90 is drawn from the upper electrode film 80 of each of the piezoelectric elements 300. Voltage is selectively applied to the piezoelectric element 300 through the lead electrode 90. In addition, the lead electrode 90 includes an underlying layer 91 made of nickel chrome (NiCr), for example, and a metal layer 92 formed on the underlying layer 91 and made of gold (Au), for example. The underlying layer 91 serves as an underlying layer for closely contacting the metal layer 92 and the insulating film 55 and also serves as a barrier layer for preventing metal forming the upper electrode film 80 and the metal layer 92 from chemically reacting.

A discontinuous metal layer 190 formed of the same material layers of the underlying layer 91 and the metal layer 92 included in each of the lead electrodes 90 and formed so as to be discontinuous from the lead electrodes 90 is formed in an area which is the periphery of the communication section 13 on the elastic film 50 and corresponds to the liquid passages. The upper surface of the discontinuous metal layer 190 is covered with the adhesive layer 35 formed of an epoxy-based adhesive, for example. The reservoir forming substrate 30 provided with the reservoir section 31 in the area opposed to the communication section 13 through the adhesive layer 35 is joined to the flow passage forming substrate 10 provided with the piezoelectric elements 300. By providing the discontinuous metal layer 190 in the area which is the periphery of the communication section 13 on the elastic film 50 and corresponds to the liquid passages, it is possible to prevent an excess adhesive from leaking without causing unevenness of the height of the periphery of the communication section 13 and the height of the lead electrodes 90, when the flow passage forming substrate 10 and the reservoir forming substrate 30 are adhered to each other.

As shown in FIG. 3, the elastic film 50 has an opening 52 in an area opposed to the communication section 13. The insulating film 55 is formed on the elastic film 50 and an opening 56 larger than the opening 52 of the elastic film 50 is formed. That is, the insulating film 55 is patterned more inward than the opening 52 of the elastic film 50. In the insulating film 55, the end portion on a side of the opening of the elastic film 50 is formed as a tapered portion of which the thickness is gradually smaller and the cross-section shape in a direction in which the thickness of the tapered portion is gradually smaller is a concavely curved plane. In other words, the cross-section of the opening 56 of the insulating film 55 is formed in the concavely curved plane.

The underlying layer 91 of the discontinuous metal layer 190 is formed so as to cover a part of the upper surface of the insulating film 55, the cross-section of the opening 56 of the insulating film 55, and the cross-section of the opening 52 of the elastic film 50. In addition, in the metal layer 92 of the discontinuous metal layer 190, the end portion on the side of the opening of the elastic film 50 protrudes toward the opening 52 of the elastic film 50 more than the opening 56 of the insulating film 55. In the underlying layer 91 and the metal layer 92 forming the discontinuous metal layer 190, surfaces (91*a* and 92*a*) of areas corresponding to the tapered portion of the insulating film 55 each have a concavely curved plane.

In this way, the insulating film 55 has the tapered portion formed such that the end portion on the side of the opening of the elastic film 50 is gradually narrowed and the cross-section shape in the direction in which the thickness of the tapered portion is gradually smaller is the concavely curved plane. With such a configuration, even when the adhesive layer 35 is thermally expanded and stress thus occurs due to occurrence of bubbles in the adhesive layer 35 or mixing of a foreign substance, the stress is not focused on the end portion on the side of the opening of the insulating film 55. In a known configuration, since stress occurring from the adhesive layer is easily focused on the end portion on the side of the opening of the insulating film, crack occurs in a portion of the elastic film contacting with the end portion on the side of the opening of the insulating film. In this embodiment, however, since the stress is dispersed in the tapered portion of the insulating film 55, it is possible to prevent crack from occurring in the area corresponding to the liquid passages of the elastic film 50.

In the reservoir forming substrate 30, a piezoelectric element preserver 32 ensuring a space so as not to interrupt the movement of the piezoelectric elements 300 is formed in an area opposed to the piezoelectric elements 300. The piezoelectric element preserver 32 has the space so as not to interrupt the movement of the piezoelectric elements 300. In addition, the space may be sealed in an airtight manner or not sealed. Only the reservoir section 31 may be configured to serve as a reservoir by partitioning the communication section 13 of the flow passage forming substrate 10 into a plurality of portions in every pressure generating chamber 12. That is, only the pressure generating chambers 12 and the ink supply passages 14 may be formed in the flow passage forming substrate 10. It is preferable that the reservoir forming substrate 30 is made of a material such as glass or a ceramic material having the substantially same thermal expansibility as that of the passage forming substrate 10.

Connection wirings 200 having a predetermined pattern are provided on the reservoir forming substrate 30 and a driving circuit 210 for driving the piezoelectric elements 300 is mounted on the connection wirings 200. The driving circuit 210 can be formed of a circuit substrate or a semiconductor integrated circuit (IC), for example. The driving circuit 210 and the lead electrodes 90 are electrically connected to each other through driving wirings 220 formed of a conductive wire such as a bonding wire.

A compliance substrate 40 including a sealing film 41 and a fixing plate 42 is joined onto an area corresponding to the reservoir section 31 of the reservoir forming substrate 30. The sealing film 41 is made of a material having a low rigidity and a flexible property. One surface of the reservoir section 31 is sealed by the sealing film 41. The fixing plate 42 is made of a material such as metal having a hard property. Since an area opposed to the reservoir 100 of the fixing plate 42 is an opening 43 completely removed in the thickness direction, one surface of the reservoir 100 is sealed only by the sealing film 41 having a flexible property.

In an ink jet printing head I according to this embodiment, ink is supplied from an external ink supply member (not shown), the inside from the reservoir 100 to the nozzle openings 21 is filled with the ink, and ink droplets are ejected from the nozzle openings 21 by applying voltage between the lower electrode film 60 and the upper electrode film 80 corresponding to each of the pressure generating chambers 12 in accordance with a print signal supplied from the driving circuit 210, deforming the elastic film 50, the insulating film 55, the lower electrode film 60, and the piezoelectric layer 70 so as to be bent, and increasing the pressure of each of the pressure generating chambers 12.

Hereinafter, a method of manufacturing the ink jet printing head will be described with reference to FIGS. 4A to 4C to FIGS. 7A to 7C. FIGS. 4A to 4C to FIGS. 7A to 7C are sectional views illustrating pressure generating chambers of a flow passage forming substrate wafer in the longitudinal direction.

Figure 4A:
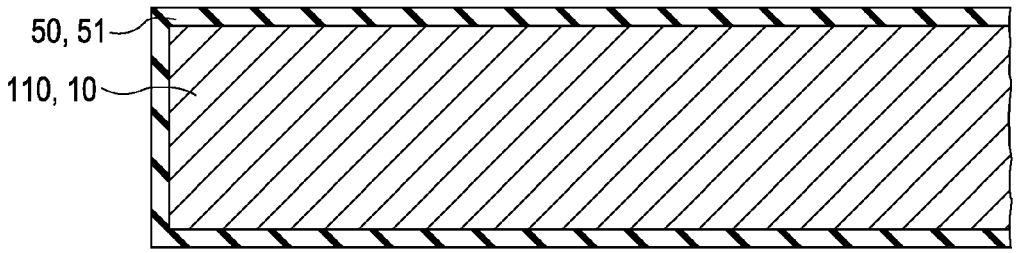
FIGS. 4A to 4C are sectional views illustrating a method of manufacturing the printing head according to the first embodiment.
Figure 4B:
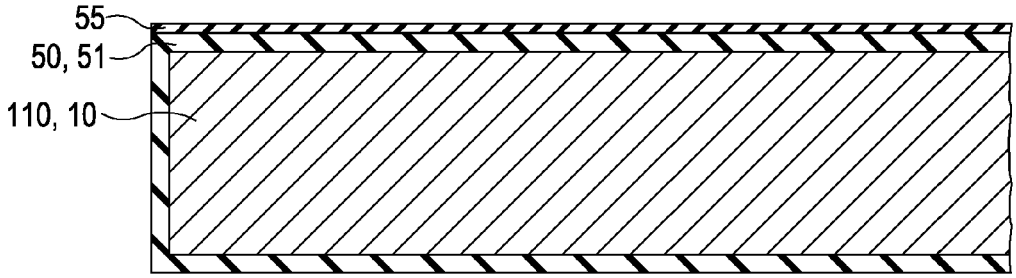

As shown in FIG. 4A, a flow passage forming substrate wafer 110 as a silicon wafer is first subjected to thermal oxidation in a diffusion furnace of about 1100° C. to form a silicon dioxide film 51 for forming the elastic film 50 on the surface of the flow passage forming substrate wafer 110. Subsequently, as shown in FIG. 4B, the insulating film 55 made of zirconium oxide is formed on the elastic film 50 (the silicon dioxide film 51). Specifically, after a zirconium (Zr) layer is formed on the elastic film 50 (the silicon dioxide film 51) by a sputtering method, for example, the zirconium layer is subjected to thermal oxidation in the diffusion furnace in the range of 500° C. to 1200° C., for example, to form the insulating film 55 made of zirconium oxide ($ZrO_2$).

Figure 4C:
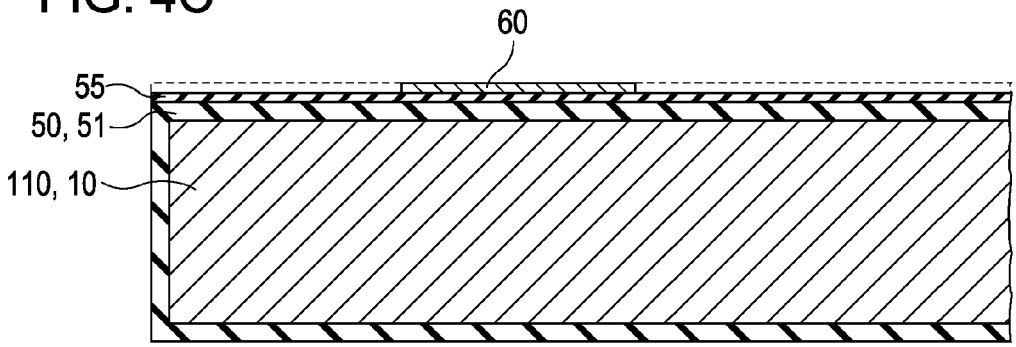

Subsequently, as shown in FIG. 4C, after the lower electrode film 60 is formed by laminating platinum and iridium, for example, on the insulating film 55, the lower electrode film 60 is patterned in a predetermined shape.

Figure 5A:
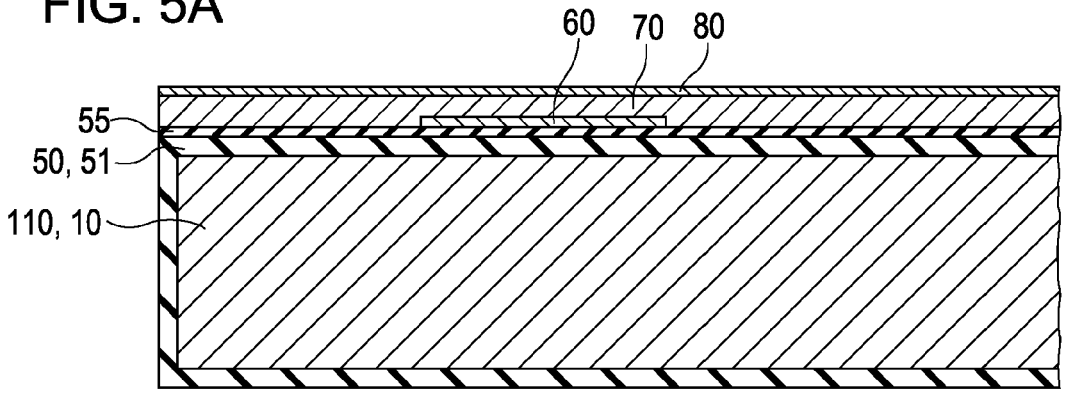
FIGS. 5A to 5C are sectional views illustrating the method of manufacturing the printing head according to the first embodiment.
Figure 5B:
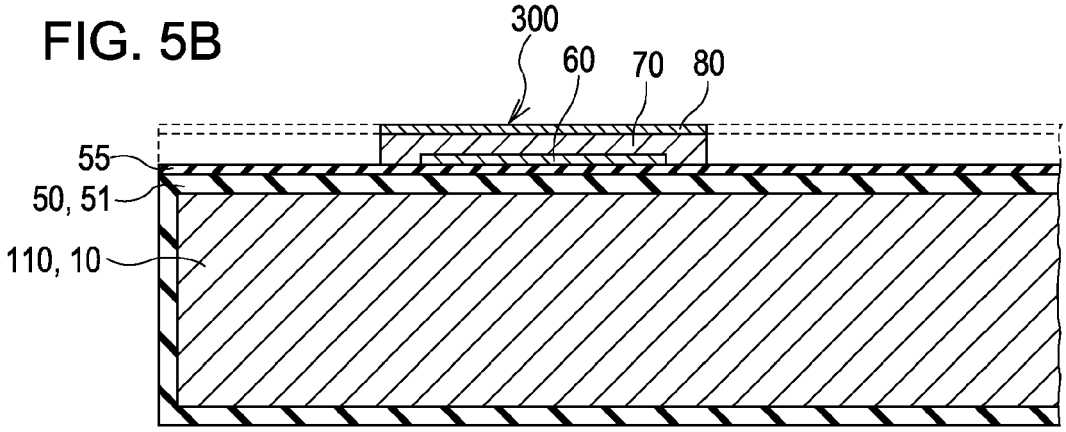

Subsequently, as shown in FIG. 5A, the piezoelectric layer 70 made of lead zirconate titanate (PZT), for example, and the upper electrode film 80 made of iridium, for example, are formed on the entire surface of the flow passage forming substrate wafer 110. Subsequently, as shown in FIG. 5B, the piezoelectric layer 70 and the upper electrode film 80 are patterned in an area opposed to each of the pressure generating chambers 12 to form the piezoelectric element 300. In addition, a method of forming the piezoelectric layer 70 is not particularly limited. In this embodiment, for example, the piezoelectric element 70 is formed by a so-called sol-gel method made of metal oxide by dissolving and dispersing a metal organic substance with a solvent, by applying and drying a so-called sol to make a gel, and by again baking the gel at a high temperature to obtain the piezoelectric layer 70.

Figure 5C:
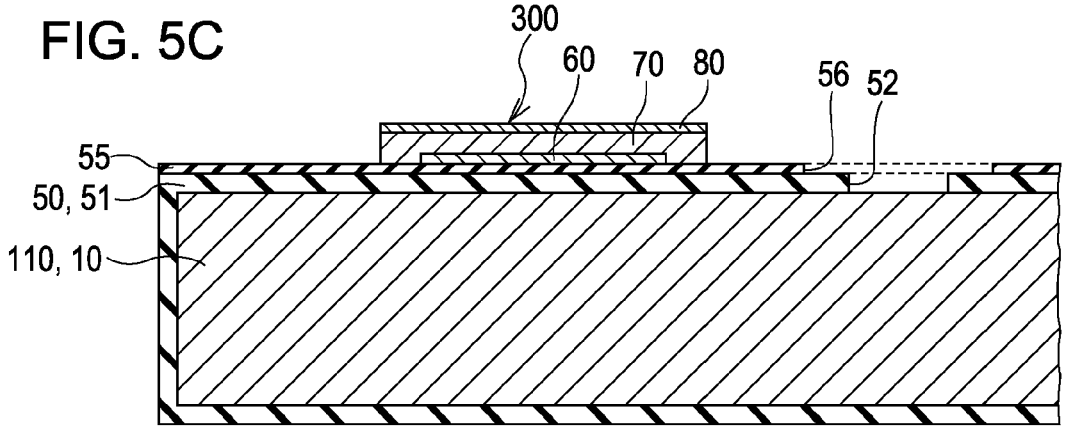

Subsequently, a mask pattern (not shown) is formed, and the insulating film 55 and the elastic film 50 are patterned by ion milling through the mask pattern to form a through-portion for exposing the surface of the flow passage forming substrate wafer 110 by perforating the insulating film 55 and the elastic film 50 in an area where the communication section (not shown) of the flow passage forming substrate wafer 110 is formed, as shown in FIG. 5C. Specifically, the opening 56 is formed in the insulating film 55 and the opening 52 is formed in the elastic film 50. At this time, the end portion on the side of the opening of the insulating film 55 is formed as the tapered portion of which thickness is gradually smaller and the cross-section shape in the direction in which the thickness of the tapered portion is gradually smaller becomes the concavely curved plane. That is, the opening surface of the opening 56 of the insulating film 55 is shaped in the concavely curved plane. Specifically, in a process of forming the resist serving as a mask pattern, by allowing the shape of the end portion of the opening of a resist as a defocus to become the concavely curved plane, the shape of the resist is transferred to the insulating film 55 at the time of forming the opening 56 in the insulating film 55 by ion milling to obtain the end portion on the side of the opening of the insulating film 55 having a desired shape. With such a configuration, even when the adhesive layer 35 is thermally expanded and stress thus occurs due to occurrence of bubbles or mixing of a foreign substance in the manufacturing process, the stress is dispersed in the tapered portion of the insulating film 55. Since the stress is not focused on the end portion on the side of the opening of the insulating film 55, it is possible to prevent crack from occurring in the area corresponding to the liquid passages of the elastic film 50.

Figure 6A:
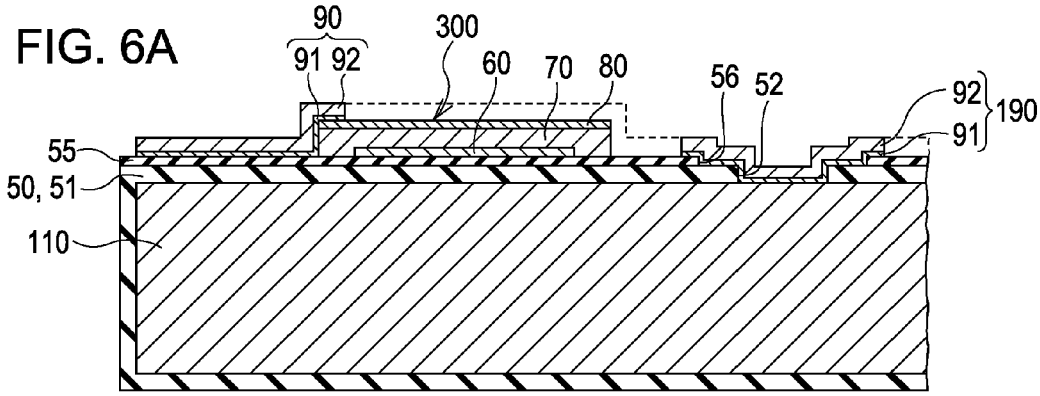
FIGS. 6A to 6C are sectional views illustrating the method of manufacturing the printing head according to the first embodiment.

Subsequently, as shown in FIG. 6A, the lead electrode 90 is formed. Specifically, the metal layer 92 is first formed on the entire surface of the flow passage forming substrate wafer 110 through the underlying layer 91, and the discontinuous metal layer 190 including the underlying layer 91 and the metal layer 92 is formed. In addition, a mask pattern (not shown) formed of a resist, for example, is formed on the discontinuous metal layer 190, and the lead electrode 90 is formed by patterning the metal layer 92 and the underlying layer 91 in every piezoelectric element 300 through the mask pattern. At this time, the discontinuous metal layer 190 discontinuous with the lead electrode 90 remains in an area opposed to the through-portion to seal the through-portion by the discontinuous metal layer 190. In addition, in the discontinuous metal layer 190, it is preferable that the surface of the area opposed to the tapered portion of the above-described insulating film 55 is shaped in the concavely curved plane.

Here, the major material of the metal layer 92 is not particularly limited, as long as the material is a material having a relatively high conductive property. For example, gold (Au), platinum (Pt), aluminum (Al), and copper (Cu) can be used. In this embodiment, gold (Au) is used. The material of the underlying layer 91 is a material ensuring a close contacting property of the metal layer 92. Specifically, titanium (Ti), titanium-tungsten compound (TiW), nickel (Ni), chrome (Cr), nickel-chrome compound (NiCr), or the like can be used. In this embodiment, titanium-tungsten compound (TiW) is used.

Figure 6B:
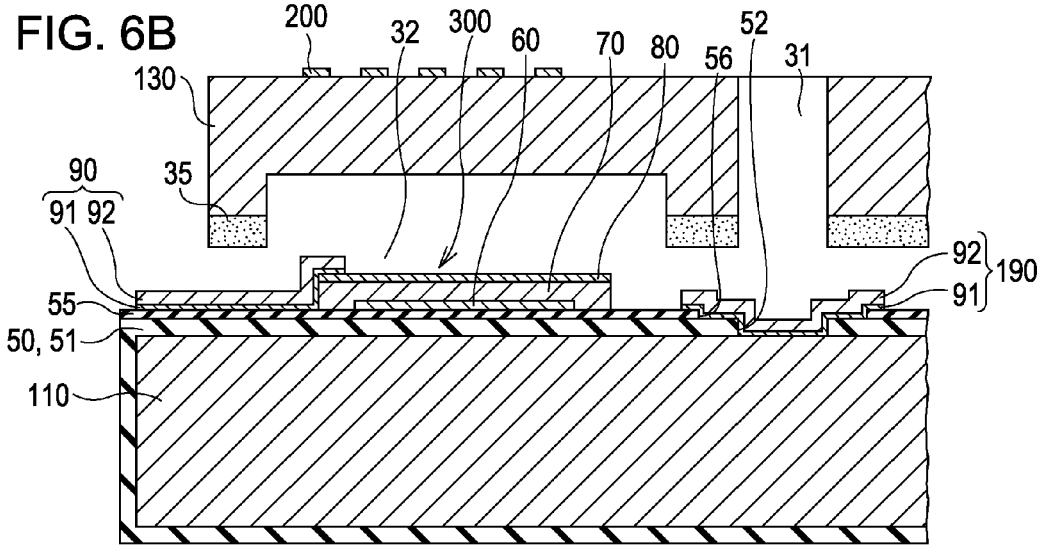

Subsequently, as shown in FIG. 6B, a reservoir forming substrate wafer 130 is adhered to the flow passage forming substrate wafer 110 through the adhesive layer 35. Specifically, both the flow passage forming substrate 110 and the reservoir forming substrate wafer 130 are adhered by applying an adhesive to the adhering surface of the reservoir forming substrate wafer 130, and then heating and hardening the adhesive in a state of pressing the reservoir forming substrate wafer 130 against the flow passage forming substrate wafer 110 under predetermined pressure. At this time, when bubbles occur or a foreign substance is mixed in the adhesive layer 35, stress occurs due to thermal expansion or the like, but the stress is dispersed in the taper portion of the insulating film 55 having the above-described configuration. That is, the stress is not focused on the end portion on the side of the opening of the insulating film 55. Accordingly, crack does not occur in the area corresponding to the liquid passages of the elastic film.

The reservoir section 31, the piezoelectric element preserver 32, and the like are formed in advance in the reservoir forming substrate wafer 130. The above-described connection wirings 200 are formed in advance in the reservoir forming substrate wafer 130. In addition, the reservoir forming substrate wafer 130 is a silicon wafer having a thickness of about 400 μm, for example. By adhering the reservoir forming substrate wafer 130, the rigidity of the flow passage forming substrate wafer 110 is considerably improved.

Figure 6C:
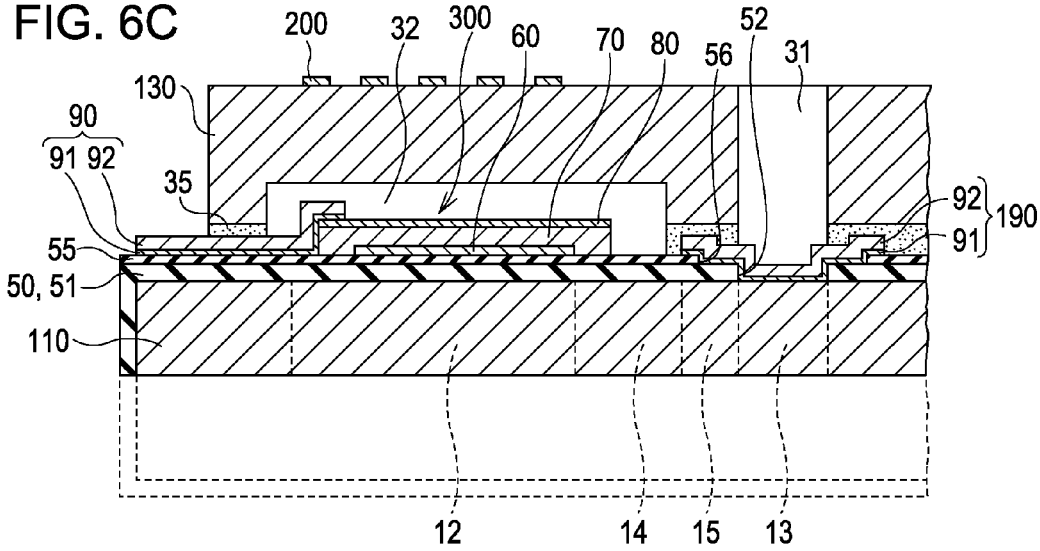
Figure 7A:
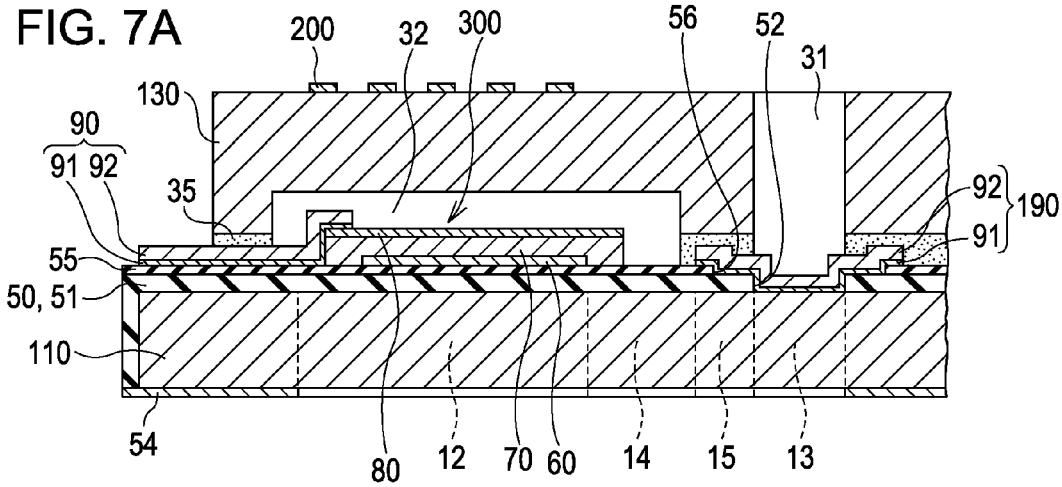
FIGS. 7A to 7C are sectional views illustrating the method of manufacturing the printing head according to the first embodiment.
Figure 7B:
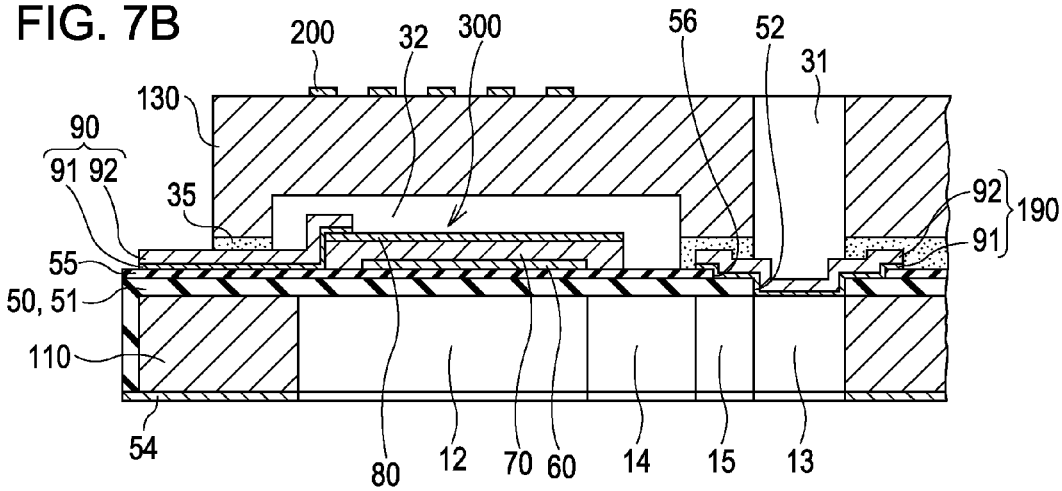

Subsequently, as shown in FIG. 6C, the flow passage forming substrate wafer 110 is formed so as to have a predetermined thickness. In this embodiment, the flow passage forming substrate wafer 110 is processed by grinding and wet etching so as to have the thickness of about 70 μm, for example. Subsequently, as shown in FIG. 7A, a mask film 54 made of silicon nitride (SiN), for example, is newly formed on the flow passage forming substrate wafer 110 and patterned in a predetermined shape. Subsequently, as shown in FIG. 7B, the flow passage forming substrate wafer 110 is subjected to anisotropic etching (wet etching) through the mask film 54 to form the liquid passages (the pressure generating chambers 12, the ink supply passages 14, and the communication passages 15 in this embodiment), the communication section 13, and the like in the flow passage forming substrate wafer 110. Specifically, the flow passage forming substrate wafer 110 is etched by an etching solution such as a potassium hydroxide water solution until the elastic film 50 and the underlying layer 91 are exposed, in order to simultaneously form the pressure generating chambers 12, the communication section 13, the ink supply passage 14, and the communication passage 15.

When the communication section 13 and the like are formed in this manner, the opening is sealed the discontinuous metal layer 190 including the underlying layer 91 and the metal layer 92. Accordingly, the etching solution does not flow to a side of the reservoir forming substrate wafer 130 through the opening. With such a configuration, the etching solution is not attached to the connection wirings 200 formed on the surface of the reservoir forming substrate wafer 130 and a defect such as line disconnection can be prevented from occurring. Moreover, a problem with etching of the reservoir forming substrate wafer 130 caused when the etching solution penetrates into the inside of the reservoir section 31 does not occur.

When the pressure generating chambers 12 and the like are formed, the surface of the reservoir forming substrate wafer 130 opposite the flow passage forming substrate wafer 110 may be again sealed with a sealing film made of a material such as PPS (polyphenylene sulfide) or PPTA (polyphenylene terephthalamide) having an alkali resistant property. With such a configuration, a defect such as line disconnection of the wirings formed on the surface of the reservoir forming substrate wafer 130 can be more reliably prevented from occurring.

Figure 7C:
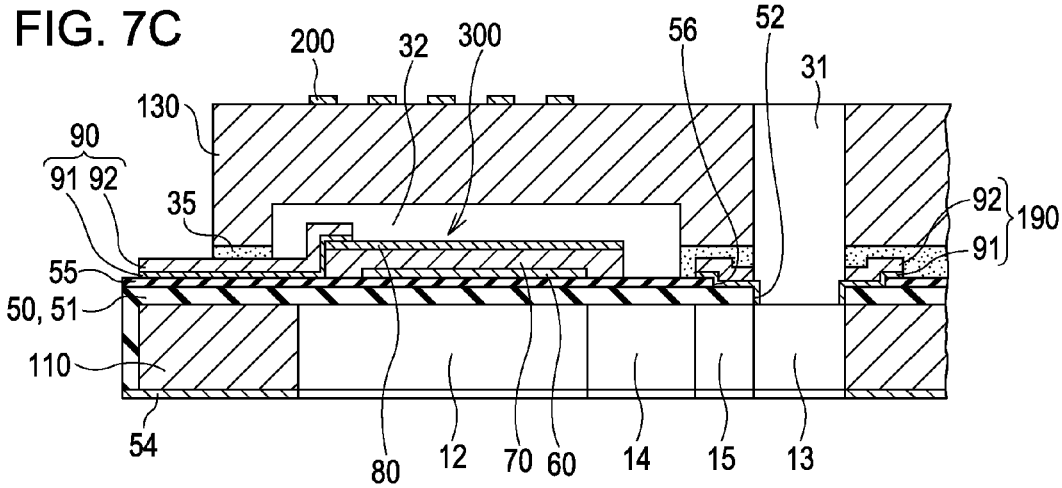

Subsequently, as shown in FIG. 7C, a part of the discontinuous metal layer 190 inside the opening is removed from a side of the communication section 13 by etching. That is, the underlying layer 91 and the metal layer 92 exposed to the side of the communication section 13 is removed by wet etching or the like.

Subsequently, the driving circuit 210 is mounted on the connection wirings 200 formed in the reservoir forming substrate wafer 130 and the driving circuit 210 and the lead electrodes 90 are connected to each other through the driving wirings 220 (see FIGS. 2A and 2B). Subsequently, unnecessary portions of the outer circumferences of the flow passage forming substrate wafer 110 and the reservoir forming substrate wafer 130 are removed by cutting such as dicing. Subsequently, the nozzle plate 20 provided with the nozzle openings 21 punched therein is joined to the surface of the flow passage forming substrate wafer 110 opposite the reservoir forming substrate wafer 130. The compliance substrate 40 is joined to the reservoir forming substrate wafer 130. Then, the ink jet printing head having the above-described configuration is manufactured by dividing the flow passage forming substrate wafer 110 and the like into the flow passage forming substrates 10 and the like having one chip size, as in FIG. 1.

As described above, the liquid ejecting head according to this embodiment is provided with the insulating film 55 patterned inward from the opening of the elastic film 50 in the adhered area on the liquid passages of the periphery of the communication section 13 on the elastic film 50. The end portion on the side of the insulating film 55 on the side of the opening of the elastic film 50 is formed as the tapered portion of which the thickness is gradually smaller. The cross-section shape in the direction in which the thickness of the tapered portion is gradually smaller is the concavely curved plane. With such a configuration, even when the adhesive layer 35 is thermally expanded and stress thus occurs due to occurrence of bubbles in the adhesive layer 35 or mixing of a foreign substance, the stress is not focused on the end portion on the side of the communication section 13 of the insulating film 55. Accordingly, it is possible to prevent crack from occurring in the elastic film 50 on the flow passage forming substrate 10.

Accordingly, the liquid ejecting head according to this embodiment is considerably improved in durability and reliability.

OTHER EMBODIMENTS

The embodiment of the invention has been described, but the invention is not limited to the above-described embodiment in the basic configuration. In this embodiment, the insulating film 55 serves as the intermediate layer, but the invention is not limited thereto. The intermediate layer is formed in the adhered area of the reservoir forming substrate 30 on the liquid passages in the periphery of the communication section 13 on the elastic film 50. For example, the insulating film 55 and the lower electrode film 60 may serve as the intermediate layer. When the intermediate layer is formed by the insulating film 55 and the lower electrode film 60, the end portion of the lower electrode film 60 on a side of the opening of the elastic film 50 is formed as the tapered portion of which the thickness is gradually smaller and the cross-section shape in the direction in which the thickness of the tapered portion is gradually smaller is the concavely curved plane.

In the above-described embodiment, the metal layer is formed of the discontinuous metal layer 190 discontinuous from the lead electrode 90. However, the metal layer may be made of a material different from that of the lead electrode 90 or may not be necessarily formed.

In the above-described embodiment, the intermediate layer (the insulating film 55) and the metal layer (the discontinuous metal layer 190) are formed in the periphery of the communication section 13 on the elastic film 50. However, in only the intermediate layer (and the metal layer) formed in the periphery of the communication section 13 and the area corresponding to the liquid passages, the end portion of the intermediate layer on the side of the opening of the elastic film is formed as the tapered portion of which the thickness is gradually smaller and the cross-section shape in the direction in which the thickness of the tapered portion is gradually smaller is the concavely curved plane. Of course, in the intermediate layer formed in an area where the liquid passages are not formed, the end portion on the side the opening may be also shaped in the concavely curved plane.

Figure 8:
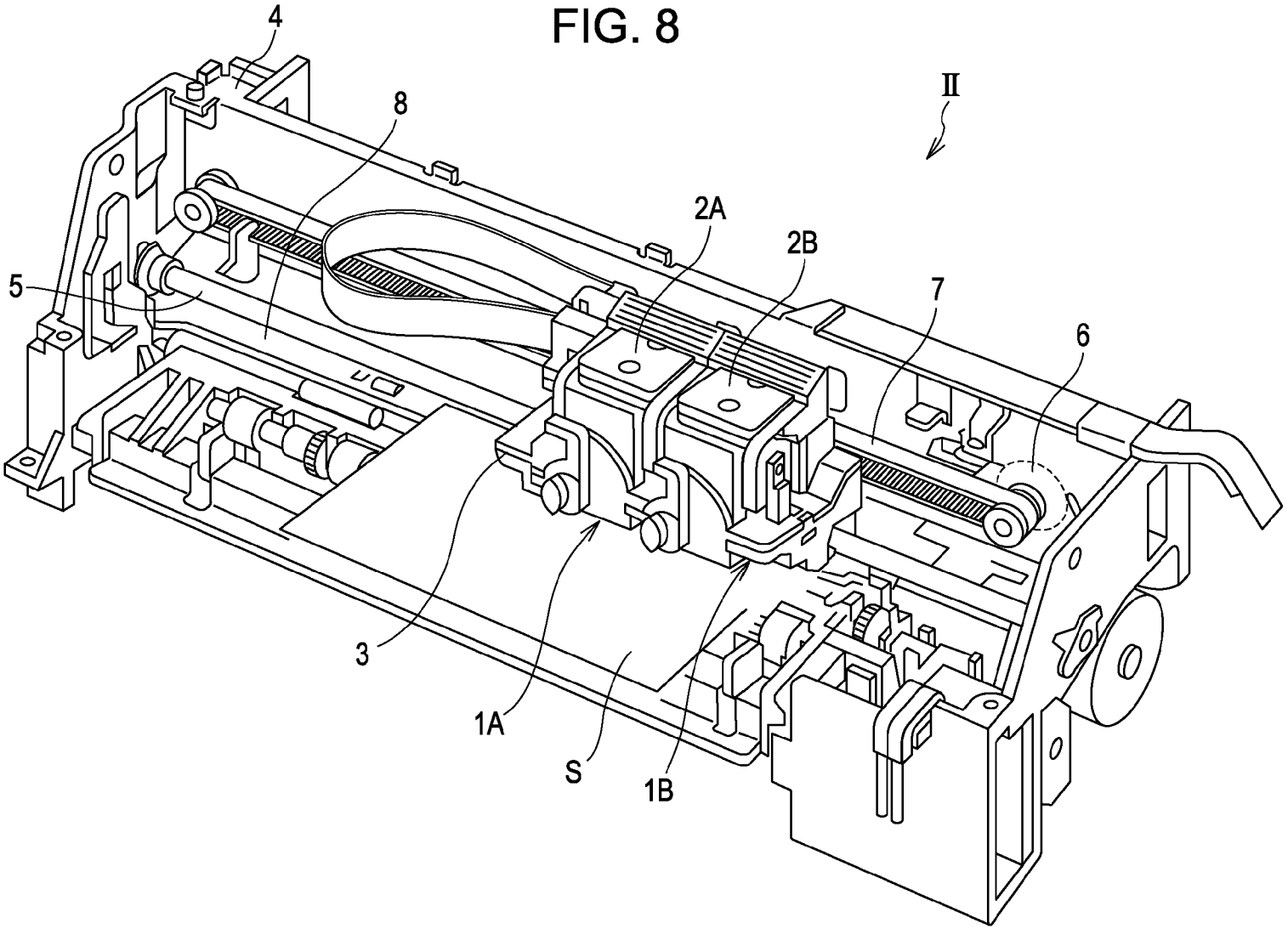
FIG. 8 is a schematic diagram illustrating an example of an ink jet printing apparatus according to an embodiment.

The above-described ink jet printing head forms a part of a printing head unit having an ink passage communicating with an ink cartridge and the like and is mounted on an ink jet printing apparatus. FIG. 8 is a schematic diagram illustrating an example of the ink jet printing apparatus.

As shown in FIG. 8, an ink jet printing apparatus II includes printing head units 1A and 1B which each have an ink jet printing head I. The printing head units 1A and 1B are provided such that cartridges 2A and 2B forming an ink supply unit are detachably mounted. A carriage 3 mounted with the printing head units 1A and 1B is provided to freely move along a carriage shaft 5 attached to an apparatus main body 4 in a shaft direction. The printing head units 1A and 1B are each configured to eject black ink and color ink, for example.

The carriage 3 mounting the printing head units 1A and 1B is moved along the carriage shaft 5 by delivering a driving force of a driving motor 6 to the carriage 3 through a plurality of toothed-gears (not shown) and a timing belt 7. On the other hand, a platen 8 is formed along the carriage shaft 5 in the apparatus main body 4. In addition, a printing sheet S as a printing medium such as a paper sheet fed by a sheet feeding roller or the like (not shown) is wound by the platen 8 so as to be transported.

In the above-described embodiment, the ink jet printing head I has been described as an example of the liquid ejecting head. However, the invention is devised so as to be applied to various liquid ejecting heads. Of course, the invention is applicable to a method of manufacturing the liquid ejecting head for ejecting a liquid other than ink. Examples of the liquid ejecting head include various printing heads used for an image printing apparatus such as a printer, a color material ejecting head used to manufacture a color filter such as a liquid crystal display, an electrode material ejecting head used to form electrodes such as an organic EL display or an FED (Field Emission Display), and a bio organism ejecting head used to manufacture a bio chip.

What is claimed is:

1. A liquid ejecting head comprising:

a flow passage forming substrate which is provided with a liquid passage having a pressure generating chamber communicating with a nozzle opening for ejecting a liquid and a communication section communicating with the liquid passage;

an elastic film which is formed above the flow passage forming substrate and has an opening in an area opposed to the communication section;

a pressure generating unit which applies pressure to the inside of the pressure generating chamber; and a reservoir forming substrate which is adhered onto the flow passage forming substrate above a side of the pressure generating unit and is provided with a reservoir section communicating with the communication section to form a part of a reservoir, wherein an intermediate layer patterned inward from the opening of the elastic film is formed in an area which is a periphery of the communication section above the elastic film and corresponds to the liquid passage, and the flow passage forming substrate and the reservoir forming substrate are adhered to each other through at least the intermediate layer, and wherein an end portion of the intermediate layer above a side of the opening of the elastic film is formed as a tapered portion of which a thickness is gradually smaller, and a cross-section shape in a direction in which the thickness of the tapered portion is gradually smaller is a concavely curved plane.

2. The liquid ejecting head according to claim 1, further comprising:

a metal layer which is provided to cover at least a part of an upper surface of the intermediate layer and the end portion of the intermediate layer above the side of the opening of the elastic film, wherein a surface of the metal layer in an area corresponding to the tapered portion of the intermediate layer is shaped in a concavely curved plane.

3. The liquid ejecting head according to claim 2, wherein the pressure generating unit is a piezoelectric element including a lower electrode, a piezoelectric layer, and an upper electrode, the intermediate layer is formed of an insulating film, and the metal layer is a discontinuous metal layer which is formed of the same material as that of a lead electrode drawn from the piezoelectric element and is discontinuous from the lead electrode.

4. A liquid ejecting apparatus comprising the liquid ejecting head according to claim 1.

* * * * *